US008170710B2

(12) United States Patent
Barea

(10) Patent No.: US 8,170,710 B2
(45) Date of Patent: May 1, 2012

(54) METHOD AND ARRANGEMENT FOR FEEDING, WITH YARN OF CONSTANT ABSORBED LENGTH, A TEXTILE MACHINE OPERATING ON A PLURALITY OF YARNS

(75) Inventor: Tiziano Barea, Busto Arsizio (IT)

(73) Assignee: B.T.S.R. International S.p.A., Olgiate Olona (IT)

( * ) Notice: Subject to any disclaimer, the term of this patent is extended or adjusted under 35 U.S.C. 154(b) by 779 days.

(21) Appl. No.: 12/327,296

(22) Filed: Dec. 3, 2008

(65) Prior Publication Data

US 2009/0139271 A1 Jun. 4, 2009

(30) Foreign Application Priority Data

Dec. 4, 2007 (IT) ..... MI2007A2269

(51) Int. Cl.
*G06F 19/00* (2006.01)

(52) U.S. Cl. ..... 700/141; 700/130; 66/125 R

(58) Field of Classification Search ..... 66/122, 66/146, 125 R, 126 R, 210, 211, 213; 226/44, 226/45; 700/130, 139, 143, 142, 144
See application file for complete search history.

(56) References Cited

U.S. PATENT DOCUMENTS 3,858,416 A * 1/1975 White et al. ..... 66/132 R
4,953,367 A * 9/1990 Memminger et al. ..... 66/132 R
5,454,151 A * 10/1995 Bogucki-Land et al. ..... 28/194
5,566,574 A * 10/1996 Tiziano ..... 73/862.473
5,838,570 A * 11/1998 Barea ..... 700/143
6,079,656 A * 6/2000 Schmodde et al. ..... 242/365.7
6,321,576 B1 * 11/2001 Barea ..... 66/132 R
6,550,285 B2 * 4/2003 Nishitani ..... 66/146
7,370,464 B2 * 5/2008 Barea ..... 57/261
7,475,709 B2 * 1/2009 Halvarsson et al. ..... 139/452
7,699,258 B2 * 4/2010 Barea ..... 242/365.7
7,896,280 B2 * 3/2011 Barea ..... 242/365.7
7,896,282 B2 * 3/2011 Barea ..... 242/418
2005/0173579 A1 * 8/2005 Barea ..... 242/365.7
2009/0139271 A1 * 6/2009 Barea ..... 66/125 R

FOREIGN PATENT DOCUMENTS

CN 200810181706.1 12/2008
EP 08169986.0 11/2008
JP 2008-309595 12/2008
WO WO 03085183 A1 * 10/2003

OTHER PUBLICATIONS

U.S. Appl. No. 12/327,296, filed Dec. 3, 2008, Tiziano Barea.

* cited by examiner

*Primary Examiner* — Danny Worrell
(74) *Attorney, Agent, or Firm* — Cozen O'Connor

(57) ABSTRACT

A method for feeding a plurality of yarns with constant values of fed length to a textile machine, each yarn unwinding from a spool and cooperating with a feed device, arranged to maintain the tension of the yarn at a predefined constant value before being directed to the textile machine. At least one control unit controls the feed to this machine such that an absorbed yarn length value to be maintained for each yarn fed to the textile machine is set or self-learnt. After measuring an actual value of the yarn length absorbed by this machine and comparing it with this predefined value, the control unit acts upon one or more feed devices and modifies the tension value of the corresponding yarn in order to make these absorbed yarn length values equal to the predefined value. A method for implementing this method is also claimed.

22 Claims, 3 Drawing Sheets

METHOD AND ARRANGEMENT FOR FEEDING, WITH YARN OF CONSTANT ABSORBED LENGTH, A TEXTILE MACHINE OPERATING ON A PLURALITY OF YARNS

The present invention relates to a method for feeding a plurality of yarns of constant yarn length to a textile machine, in accordance with the introduction to the main claim. The invention also relates to an arrangement for implementing said method.

As it is known, devices which enable yarn to be fed in constant quantity to a textile machine have been commercially available for some time. These devices, used for example on circular knitting machines, comprise a plurality of wheels about which a number of yarn turns are wound. These wheels are rotated by a transmission member (belt) connected to a variable expansion pulley and rigid with the drive shaft of the machine which rotates the usual machine cylinder thereof on which the article (for example knitted fabric) is formed.

By virtue of this direct connection with the machine shaft, the wheels provide a constant yarn quantity to the machine, this quantity being adjustable because of the facility for expanding the pulley keyed onto this shaft.

Although the aforesaid known device enables a constant predetermined yarn quantity to be fed with absolute certainty to the textile machine, it presents various drawbacks. For example, if different yarn quantities are to be fed for different feed units, different transmission belts have to be used together with corresponding variable expansion pulleys adjusted to each ensure a constant yarn feed, but with said yarn quantities being different for different pulley groups. This known solution therefore requires a large number of pulleys, the number of which must however be limited for obvious reasons of bulk and of space limits about the textile machine.

The known system also presents a considerable drawback related to the fact that the yarn quantity absorbed by the textile machine always depends on the adjustment of the machine members which withdraw the yarn and which process it. For example, in a knitting machine these members are stitch cams which determine the stroke of a usual needle forming the fabric or stitch.

The problems in the aforesaid known devices derive precisely from the fact that the needle stroke determined by the cams should be constant with time to ensure correct stitch formation. However in reality this is not the case, in that mechanical wear and temperature variations detract from this constancy. For example, expansion undergone by the materials defining the various machine parts in passing from a cold machine to a hot machine causes the needle stroke to vary, with constant variation in the quantity of yarn fed. As the ratio of yarn absorbed to yarn fed determines the yarn tension, modifying the stroke of the needles acting on the yarns results in modification of their tension, with consequent formation of defects (streaks) in the finished product.

Consequently, even if the constant quantity yarn feed devices operate correctly, the wear undergone by the mechanical parts forming the stitch (needles, sinkers and cams) and the dimensional variations of such parts (thermal expansion) during normal machine operation lead to a lack of constant quantity yarn feed, with consequent production of defective or poor quality products.

To this there is also added the fact that to ensure a constant yarn quantity fed to a textile machine by a wheel connected to its drive shaft, said yarn must be free of elasticity. In reality this is not the case. Each yarn possesses its own elasticity resulting in yarn elongation depending on the tension to which it is subjected, this tension also varying as the yarn quantity present on the spool from which the yarn is unwound varies (spool full or empty). These tension variations at the entry to the yarn feed wheel cause variations in the yarn quantity at the entry to the machine stitch formation members, with consequences for the article production.

All this is more evident the greater the fineness (number of needles per inch) of the knitting machine. Current machines have more than 44 needles per inch, and it is clear that as the stitch loop is very small, a small variation in the stroke of the needle forming the stitch makes it highly possible that defective articles will be produced, even if only one of the yarns being worked undergoes variation in the absorbed yarn length (LFA).

Devices are also known for feeding yarns at constant tension to a textile machine. These devices operate such as to achieve, by closed-loop regulation, continuous control (measurement/regulation) of the feed yarn tension, which is maintained constant at a set value. However even the use of these devices does not ensure that a constant yarn quantity always reaches the machine.

In this respect, said devices effectively ensure that the yarn leaving them has a constant tension. However, this tension can change close to the textile machine, for example a knitting machine, because of passage of the yarn through thread guides located along the path between each device and those members (needles in the latter case) which withdraw it and work it within the stitch formation cylinder. These thread guides exert friction on the moving yarn, modify its tension and consequently cause a variation in the yarn length or quantity absorbed by the machine. This can also happen by erroneous regulation of the reference tension (or zero tension, this being the tension measured by the device in the absence of load on the measurement member or load cell). As a result of the aforegoing there is hence a real possibility of forming a defective product. This possibility can only be avoided by specific (and continuous) regulation of the machine members forming the stitch. However as these are subjected to the aforesaid wear and dimensional modifications, the already described problem also exists in relation to these members, i.e. maintaining the yarn length absorbed by the textile machine constant with time (with a consequent production problem).

EP050742 describes the use of a constant tension yarn feed device which simultaneously precisely measures the fed yarn quantity or length (LFA) and uses this measured value to regulate by feedback those machine members forming the stitch. Although effective, this known solution requires the textile machine to include, for these members, actuators (such as electric stepping motors) or regulating devices to be operated to maintain the desired LFA value controlled with precision.

Although such actuators are present on machines of recent production, they are not present on textile machines produced some time ago and neither is it possible to insert them in these latter, given the complexity of including such actuators.

Finally, such actuators for regulating the stitch formation members are currently present on all new machines with a small number of feeders such as stocking, stocking tights and seamless machines, but are absent on large-diameter knitting machines, given the large number of feeders (84, 96, . . . ).

Finally, yarn feed devices for looms are also known, known as accumulation feeders, which are able to withdraw the yarn from a spool, and deposit it on its own rotating member from which it is withdrawn by the textile machine. The rotating member is opposed by a tensioning element able to define the final tension at which the yarn is withdrawn from the machine.

Although ensuring yarn withdrawal at controlled tension (defined by the tensioning element), this known solution does not ensure that this tension is maintained with time because of the inevitable wear of the tensioning element, normally composed of a plastic ring or annular brush. This means that said member or element has to be replaced or adjusted in good time to avoid production of defective articles.

Hence from the aforegoing it will be apparent that currently available devices, although appreciated in use, present limits and drawbacks related mainly to wear of mechanical parts (of the devices themselves or of the textile machine members with which they cooperate) which inevitably lead to the inability to maintain an LFA which is constant with time for each article produced, or which is equal for all yarns fed to a textile machine.

An object of the present invention is therefore to provide a method and an arrangement for feeding, in a controlled manner by known yarn feed control devices, a plurality of yarns to a textile machine such that the length of each yarn absorbed (or LFA) is always constant with time for the entire production of articles of the same type, or is equal for all yarns fed to the machine.

A particular object of the invention is to provide a device and method of the aforesaid type which enable this constant LFA to be achieved without any need to intervene on the textile machine to which each yarn is fed or on the devices which feed them, hence enabling said device to be applied to, and said method to be implemented on, any type of machine, of new production or already installed and operating, provided or not provided with actuators for regulating the stitch formation members for article production.

Another object is to provide an arrangement and a method of the stated type able to ensure a constant absorbed yarn length independently of the inevitable friction to which the yarn is subjected due to its cooperation with thread guides or equivalent elements prior to its absorption by the textile machine.

Another object is to provide a method and an arrangement of the stated type able to intercept any formation of a residual yarn deposit or of loose elements which could limit free yarn travel in proximity to each thread guide before this is able to cause a quality defect in fabric production (for example related to streaking), and also to prevent yarn breakage.

Another object is to provide a method and an arrangement of the stated type able to ensure the maintenance of a constant absorbed yarn length which is equal or different for each yarn feed to the textile machine and applicable in combination with all known yarn feed devices.

A further object is to provide a method and an arrangement of the stated type which can be used on textile machines producing continuous fabric, such as looms, on knitting machines, and on machines producing separate articles, such as stocking, tights and similar machines.

These and other objects which will be apparent to the expert of the art are attained by a method and an arrangement in accordance with the accompanying claims.

For a better understanding of the present invention the following drawings are provided by way of non-limiting example in which.

Figure 1:
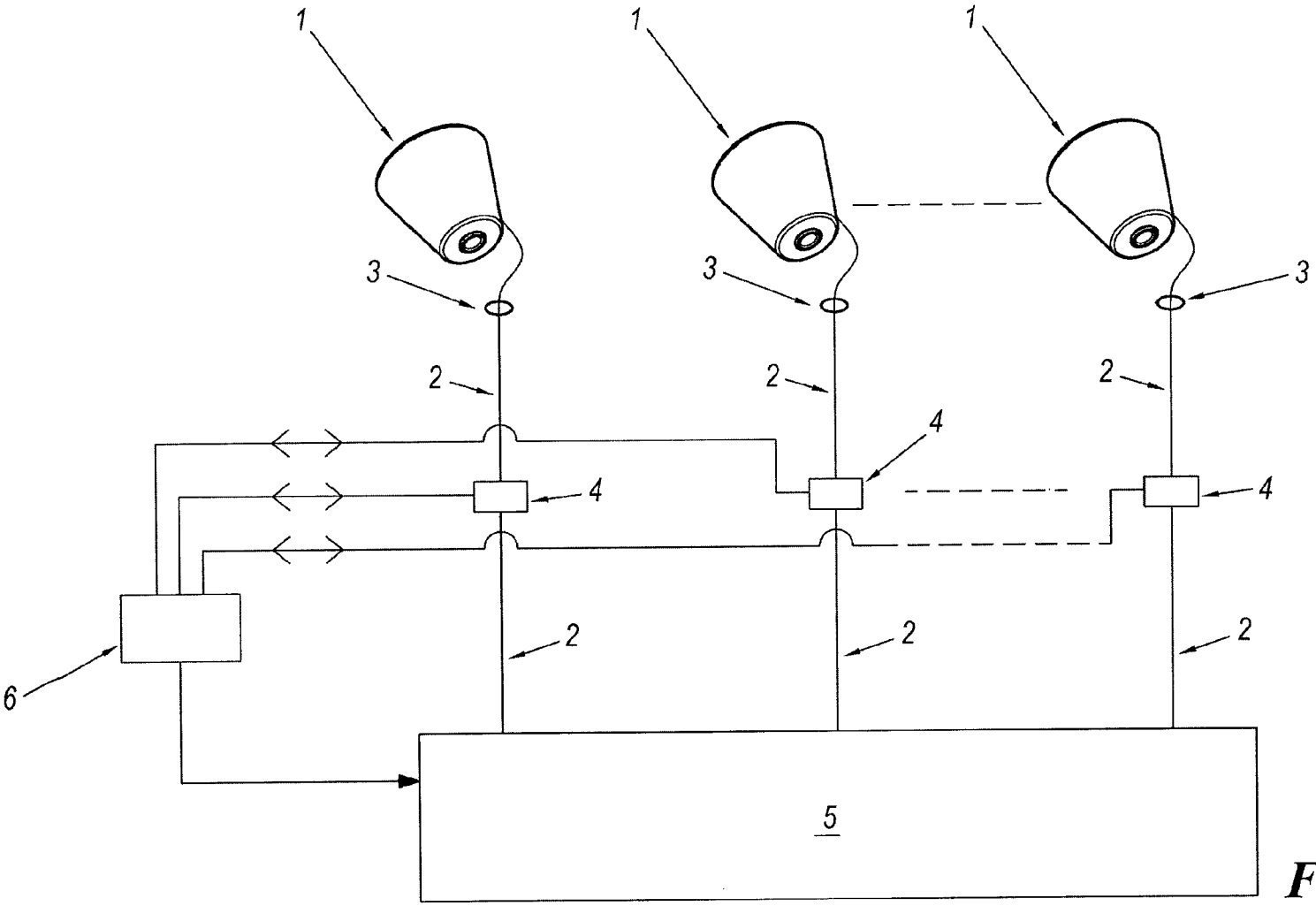
FIG. 1 is a schematic view in the form of blocks, showing an arrangement according to the invention.

With reference to FIG. 1, an arrangement according to the invention comprises a plurality of spools 1 from which corresponding yarns 2 unwind to pass through thread guides 3 to reach known devices 4 for controlling the feed of each yarn to a textile machine 5. Between each device 4 and the machine 5, which can be a loom, a knitting machine, a machine for producing stockings or the like, there can be one or more thread guides of any type. The devices 4 are of the type able to control and adjust the tension of the corresponding yarn 2, to maintain it constant.

Each device 4 is connected, for example via a serial line, to a microprocessor unit 6 able to check that the feed of each yarn 2 takes place with constant yarn length (LFA) absorbed by the machine 5; in other words, the unit 6 checks that the LFA value remains constant during the entire production stage of the machine 5. This is achieved by acquiring data on the absorbed yarn length (LFA) measured for each yarn 2 by the corresponding device 4, then modifying if necessary the feed tension of said yarn 2 by acting on the corresponding device 4, to obtain the necessary correction to the LFA value in order to maintain the measured LFA value equal to the desired setpoint value.

In FIG. 1, the unit 6 is shown external to the devices 4; however advantageously, each of these latter possesses a unit equivalent to that indicated by 6 in the figures, said unit internal to each device controlling the operation of this latter and being able independently to communicate with the machine 5 via, for example, a serial connection to a usual machine control unit.

The arrangement of FIG. 1 enables the inventive method to be implemented both on textile machines producing separate articles, such as stocking, seamless and similar machines, and on textile machines producing continuous fabric, such as looms, circular knitting machines and the like. The implementation of the method with reference to machines of the first type (for separate articles) is shown by way of example in the diagram of FIG. 2, while the implementation of the method for machines of the second type (fabric or continuous articles) is shown by way of example in the diagram of FIG. 3.

Figure 2:
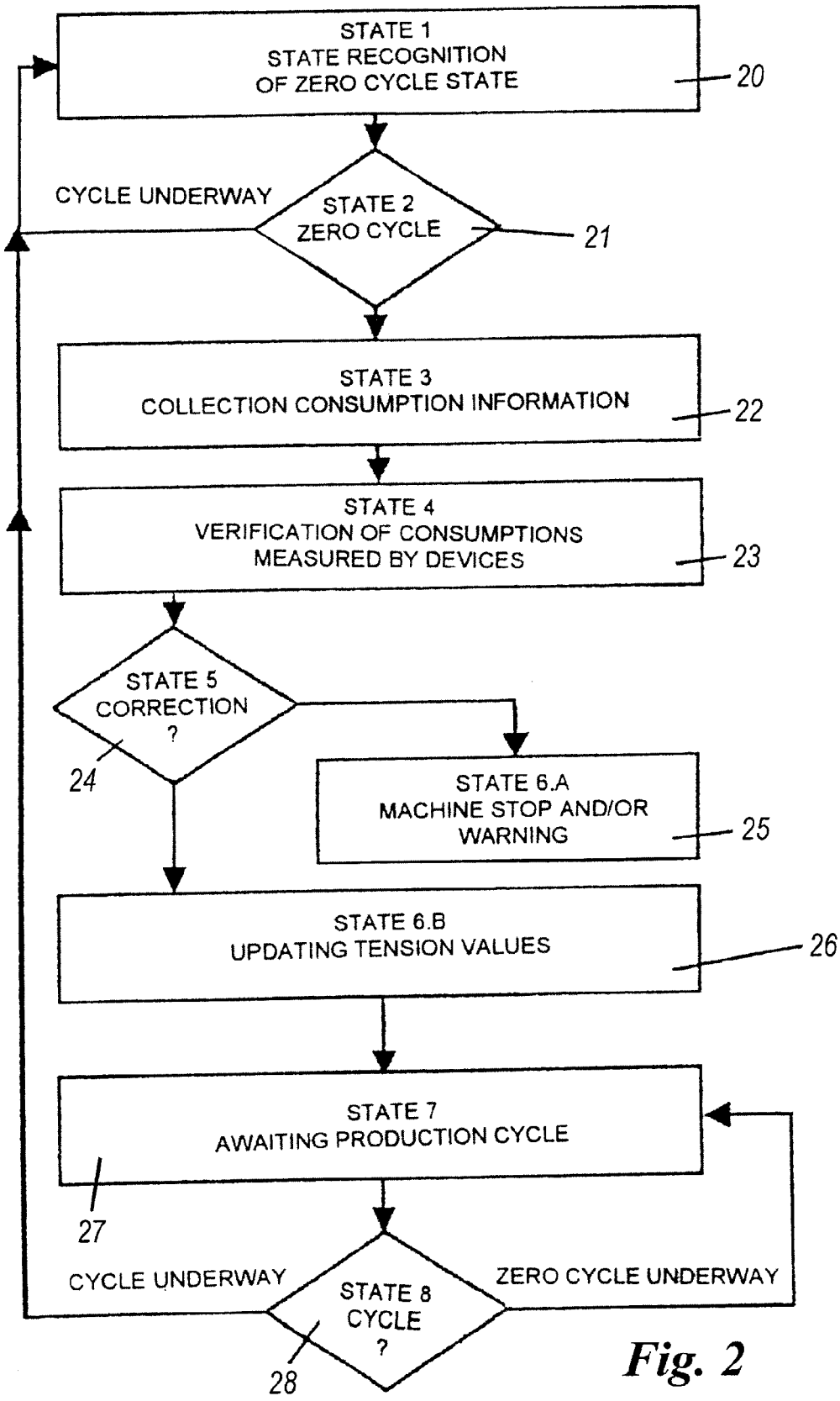
FIG. 2 is a flow diagram of a first embodiment of the method according to the invention.

With particular reference to FIG. 2, it should be noted firstly that in machines for separate article production it is always possible to identify that which is commonly known as the "cycle", associated for example with the production of a single article (for example a single stocking). Consequently, hereinafter in the present text the term "production cycle" is used to indicate the machine production stage and the term "zero cycle" is used to indicate the passage stage from one "production cycle" to the next.

To implement the method for maintaining constant the length of each yarn absorbed (LFA) by the machine in producing the article, a reference value for said LFA is defined. This value or setpoint can derive from a self-learning cycle (known per se) by the devices 4 during which each device measures the value of the length or quantity yarn fed to the textile machine (5) for producing the article, said value then being memorized in the unit 6 as the reference value for each device 4 after an analysis by an operator responsible for producing the product obtained, this analysis being targeted on obtaining a defect-free article.

Alternatively, this setpoint can be memorized directly in each device 4 (if the control unit 6 is present in each device) on the basis of previously obtained production data. In both cases, each device 4 (controlled by the internal or external unit 6) can operate on the basis of an LFA value equal to or different from the data on which the other devices of the inventive arrangement operate.

The setpoint value can also be an average LFA value calculated among all the devices 4 after producing a first verified and accepted product.

While producing the single article, it can happen that the fed yarn quantity (LFA) for each revolution or rotation of the usual knitting machine cylinder is not constant and moreover is different for each individual feeder during the entire "production cycle", and hence varies during the various sages of the process due, for example, to discontinuous absorptions due to stitch patterns, selections or contractions; hence the control method of the invention can be implemented by carrying out a check at each cycle end. The object of this control is therefore to minimize during all the "production cycles" the calculated error between the yarn quantity (LFA) fed by each device and the relative setpoint (possibly self-learnt value), in order to make them constant and equal for each article produced.

According to the method implemented by the diagram of FIG. 2, the control for maintaining constant LFA values for all yarns fed to the machine 5 commences with the step according to state 1 (block 20 of FIG. 2). During this step the control unit 6 checks whether the machine 5 is in the "production cycle" stage or in the "zero cycle" stage. This state can be determined by monitoring a signal originating directly from the machine and relative to a drive shaft of this latter, by a sensor suitably positioned on the machine (on this shaft), by means of a serial command if the control unit 6 is integrated with a machine control unit or in various other known ways.

In state 2 (block 21), while the machine is in the "production cycle", the unit does not execute any operation; however, as soon as it detects (by the aforedescribed manner) passage to "zero cycle", the unit 6 passes to the next state. In this next state 3 (block 22), the control unit 6 interrogates, for example via the serial line, the individual devices 4 to collect information on the yarn quantity fed (LFA) during the "production cycle".

Having carried out the interrogation, in state 4 (block 23) the control unit compares the consumptions or length of absorbed yarn (LFA) of each device 4 with the set or self-learnt setpoint and makes the necessary corrections to the working tension of each device 4 in order to eliminate the extent of the possible error. In practice, if the unit detects that the yarn feed is greater than that set, it increases the working tension of the device 4 whereas if it detects that it is less it reduces its working tension. The extent of the tension correction to be transferred to the individual feed device can be of a constant value (possibly programmable) or a function of the calculated error.

In the next state 5 (block 24) the unit 6, before passing the correction of block 23 to the individual device 4, verifies that the difference between the new working tension and the starting tension is not greater than a fixed or programmable value, before passing to the next state. If the state 6A (block 25) and the unit 6 verify that the extent of the difference between the new working tension and the starting setpoint is greater than a fixed or programmable value, it proceeds by halting the machine or indicating to the operator that it is entering a limiting region, beyond which it could be impossible to maintain the consumption or fed yarn length constant. For example, the tension could be very close to the minimum or maximum tension settable on the device 4 or to the maximum tension withstandable by the yarn.

Having verified that the value of the new tension to be set is acceptable, the unit 6 (state 6B, block 26) sets for each device the new tension value to be used in the next production cycle. This unit enters a waiting state and in state 7 (block 27) it limits itself to monitoring machine passage from the "zero cycle" state to the "production cycle" state.

As soon as the control unit 6 realizes that the "zero cycle" stage has passed to the "production cycle" stage (state 8, block 28), it passes to state 1.

The preceding description is evidently only one of the methods of implementing the invention; in this respect, many variants can be made to the method without modifying the invention. Some possible modifications and/or variants to that described in relation to FIG. 2 are given below. These variants are the following:

a) as stated, the entire control can be carried out not by an external unit, but by each feed device, suitably interfaced with the machine to verify the passage from "production cycle" to "zero cycle". This device 4 contains an equivalent to the unit 6;

b) the control unit can have as its LFA setpoint not a fixed reference (self-learnt or set), but the LFA value measured by an independent reference device or obtained as the average of the LFAs originating from a number or from all of the devices 4;

c) the entire LFA control could be carried out not by an external unit 6 but by one of the feed devices 4 used as a master which commands all the other devices 4, which operate as slaves;

d) the unit 6 instead of being limited to carrying out a control at the end of each "production cycle" could carry out several control cycles during the same "production cycle", for example every fraction of a revolution or every "n" revolutions of the textile machine cylinder;

e) not all the "production cycles" have necessarily to be equal but could be fixed repetitions of different cycles (article 1, article 2, article 2, . . . ). This case can also be handled by the unit 6 by suitable arrangement.

Figure 3:
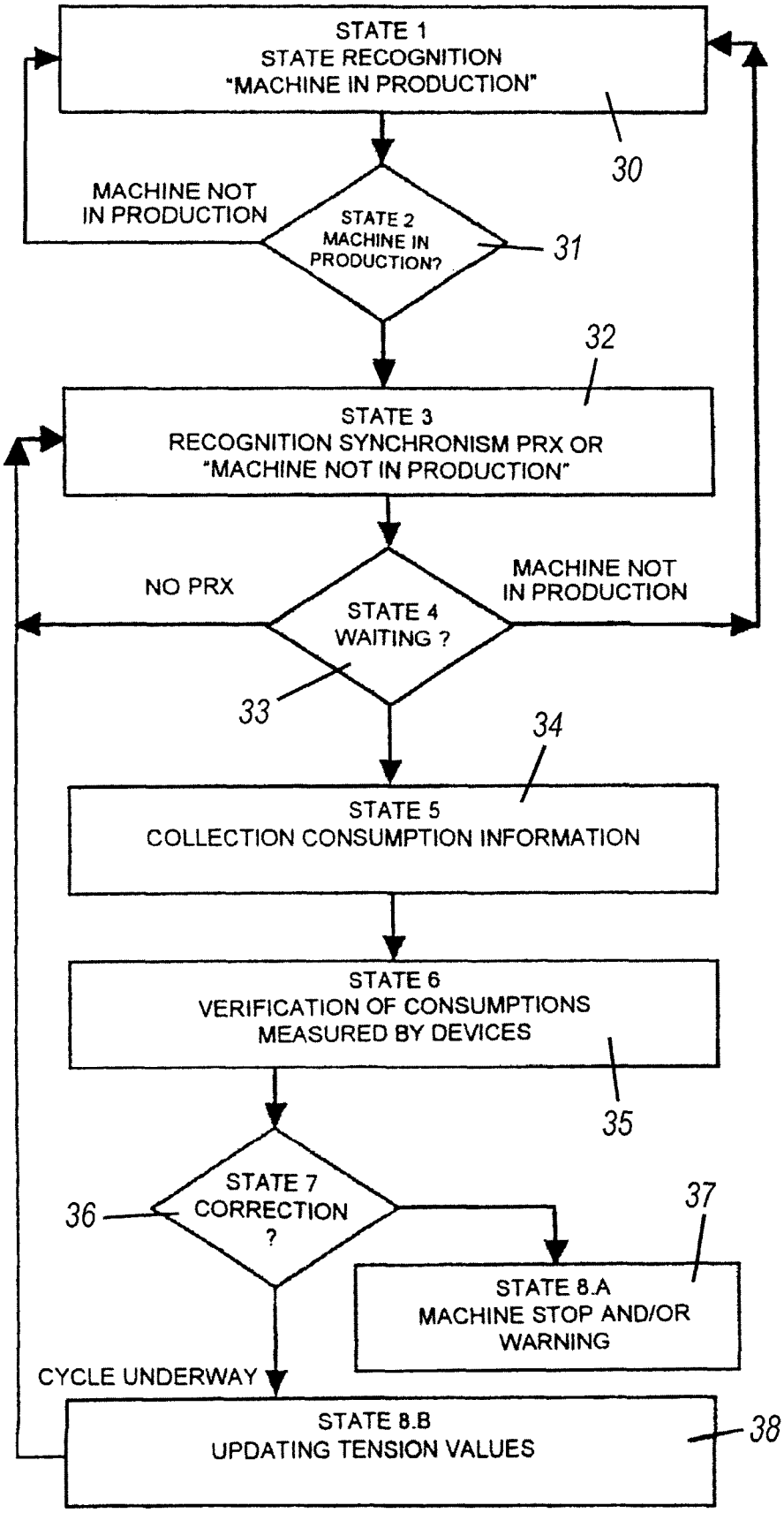
FIG. 3 is a flow diagram of a second embodiment of the method according to the invention.

FIG. 3 will now be examined and described, relative to the implementation of the method of the invention in a textile machine which produces a continuous fabric or article. In this type of process it is not possible to establish a difference between the "production cycle" and "zero cycle", but it is possible to identify two machine states which will be indicated hereinafter as "machine in production" and "machine not in production". As it is not possible to have a reference signal or "zero cycle" for the machine, a synchronization signal (PRX) is required for pacing the control. This signal can be a signal originating from the machine or from a sensor suitably positioned on the machine or via a command fed through a serial line and synchronized with the process. For example, a PRX signal can originate at each fraction or multiple of a revolution of the machine cylinder or be timed.

The object of the inventive method is therefore to minimize during the "machine in production" stage the calculated error between the yarn quantity (LFA) fed from each device and the relative setpoint, which can be obtained as in the previously described case in relation to FIG. 2.

The implementation of the method commences with the state 1 (block 30 of FIG. 3); during this stage the control unit 6 checks if the machine 5 is in the "machine in production" or "machine not in production" state. This state can be determined by monitoring a signal originating directly from the machine, by a suitably positioned sensor, by means of a serial command if integrated with the machine or in other known ways.

While the machine 5 is in the "machine not in production" state, the unit 6 does not carry out any operation, however when in state 2 (block 31) it checks the state of the machine. As soon as it detects the "machine in production" state, the unit passes to the next state.

In state 3 (block 32) the unit 6 remains awaiting a PRX signal of synchronism or of recognition of the "machine not in production" state. The determination of the arrival of this signal can be achieved by monitoring a signal (hardware) originating directly from the machine, from a suitably positioned sensor, or via a serial command in the case of integration with the machine.

While the machine is in the "machine in production" state, the unit 6 (state 4, block 33) does not carry out any operation, but continues to monitor its state. If the "machine not in production" state occurs, this unit passes from state 1 (block 30); if instead a PRX signal is detected, the unit passes to the next state or state 5 (block 34). In this latter the control unit 6 interrogates via the serial line the individual devices, to collect information on the yarn quantity fed (LFA) during the interval between two synchronism signals (PRX). In the next state 6 (block 35), the control unit 6 compares the length of the fed yarn (LFA) from each device with the set setpoint and makes the necessary corrections to the working tension in order to reduce and eliminate the extent of the error. In practice, if the algorithm finds that the yarn consumption is greater than that set, it increases the working tension of the device whereas if it finds that it is less it reduces its working tension. The extent of the tension correction to be passed to the individual feed device 4 can be a constant value (possibly programmable) or a function of the calculated error.

In the next state 7 (block 36) the unit 6, before transferring this correction to the individual device 4, verifies that the difference between the new working tension and the setpoint tension is not greater than a fixed or programmable maximum allowable correction value, before passing to the next state. If the unit 6 detects (state 8A, block 37) that the extent of the difference in the new working tension is greater than the maximum allowable correction value, it halts the machine and/or indicates to the operator that it is entering a limiting region, beyond which it could be impossible to maintain constant consumption. For example, the tension could be very close to the minimum or maximum tension settable on the feeder or to the maximum tension withstandable by the yarn. This indication takes place in known manner by light-emitting or acoustic devices.

If the corrected tension is acceptable, then (state 8B, block 38) the control unit sets for each device 4 the new tension value to be used for maintaining the desired LFA value constant.

As in the case of FIG. 2, the preceding description is evidently only one of the methods of implementing the invention applied to continuous production textile machines. Other variants can be as follows:

a) the control unit could be internal to each device suitably interfaced with the machine, to verify passage from "machine in production" to "machine not in production" and to receive the PRX synchronism signal;

b) as in the case of FIG. 2, the unit 6 can have as its LFA setpoint not a fixed reference (self-learned or set) but instead the LFA value measured by a reference device or obtained as the average of several devices;

c) the method could be implemented by the actual control unit of one of the feed devices used as the master;

d) the machine processing stage during the "machine in movement" state could, instead of being constant for the entire production, be variably cyclically or randomly, it hence being the unit 6 or the machine 5 itself, suitably interfaced, to vary the absorbed yarn length LFA set point for each PRX control synchronism.

In the light of the aforegoing, the method of the invention can be summarized and generalized in the following manner. A control unit 6 (external to the devices 4 or a part of them or of only one of them), on the basis of a setpoint value (obtained after a sample production and/or self-learning cycle during which an article without defects is obtained), verifies the yarn length (or LFA) fed by each device 4 to the textile machine 5. This check takes place on termination of a reference period which can be the period for producing a finished article or a time period defined by successive reference signals.

The unit 6 compares the real LFA value corresponding to the actual yarn quantity fed by each device 4 to the textile machine during the reference period with the setpoint value; if there is a discrepancy between them, it proceeds to vary the tension value for each individual device 4 for which the discrepancy was detected in order to return the LFA value to the prefixed setpoint value.

The invention results in attainment of the objects of the invention indicated in the introduction to the present document.

Various embodiments of the invention have been described and mentioned. Others are however attainable on the basis of the aforegoing description and are to be considered as falling within the scope of the following claims.

The invention claimed is:

1. A method for feeding a plurality of yarns to a textile machine (5) for manufacturing either single articles or a continuous fabric or article, said feeding being carried out with the yarns having a constant fed length, each yarn (2) unwinding from a spool (1) and cooperating with a usual feed device (4), arranged to maintain the tension of the corresponding yarn (2) at a predefined value, before being directed to the textile machine (5), there being provided at least one control unit (6) connected to all the feed devices (4) for controlling the yarn feed to said machine (5), the absorbed yarn length value to be maintained for each yarn (2) fed to the textile machine (5) being set to a predefined setpoint value, characterized by measuring the actual values of the yarn length fed by each feed device and effectively absorbed by said machine (5), comparing these predefined setpoint values with said measured actual values and acting on at least one of said feed devices (4) to modify the feed tension value of the corresponding yarn (2) whenever this comparison indicates a deformity between said predefined setpoint values and the actual measured values, said feed tension modification making the actual absorbed yarn length value equal to the predefined setpoint value.

2. A method as claimed in claim 1, characterised in that the predefined value is a setpoint value determined after producing a sample article during which each feed device (4) has measured the quantity of the corresponding yarn fed to the textile machine, said setpoint value being identified after analyzing said sample product and verifying the absence of defects therein, said value then being memorized and used as set absorbed yarn length reference value for subsequent comparison with corresponding actual values measured by each feed device.

3. A method as claimed in claim 1, characterised in that the predefined value is set on the basis of predefined production data deriving from previous productions.

4. A method as claimed in claim 1, characterised in that the predefined value is obtained as an average of measurements of the yarn lengths fed by a plurality of devices for feeding yarns to the textile machine during the production of a sample product free of defects.

5. A method as claimed in claim 1, characterised in that the predefined value is memorized in a control unit (6) external to the feed devices (4) for the yarns (2), said unit (6) superintending the implementation of the method.

6. A method as claimed in claim 1, characterised in that the predefined value is memorized in a control unit of each of the devices (4) for feeding yarns to the textile machine (5), each of these devices being interfaced directly with this latter.

7. A method as claimed in claim 1, characterised in that the predefined value is memorized in a control unit of one of the devices (4) for feeding yarns to the textile machine (5), said device in which the predefined value is present governing the control and regulation of the tension of the relative yarns of all the other feed devices.

8. A method as claimed in claim 1, characterised in that the measurement of the actual value of the absorbed yarn length takes place within a predefined time period.

9. A method as claimed in claim 8, characterised in that this predefined time is the time between the beginning and end of the production of an article.

10. A method as claimed in claim 8, characterised in that this time is that between two synchronization signals related to the production stage of the textile machine.

11. A method as claimed in claim 1, characterised in that the comparison between the predefined value and the actual value takes place before the commencement of every production cycle for an article produced in a textile machine for the production of separate articles.

12. A method as claimed in claim 1, characterised in that the comparison between the predefined value and the actual value takes place following the generation of a reference signal corresponding to a particular predefined moment in the production stage of a textile machine arranged to produce a continuous article.

13. A method as claimed in claim 1, characterised by generating a warning signal if the tension modification, required for maintaining the fed yarn length constant, exceeds a predefined value.

14. A method as claimed in claim 1, characterised by halting the textile machine (5) if the tension modification, required for maintaining the fed yarn length constant, exceeds a predefined value.

15. An arrangement for feeding a plurality of yarns to a textile machine (5) for manufacturing either single articles or a continuous fabric or article, said feeding being carried out with the yarns having constant fed length, each yarn (2) unwinding from a corresponding spool (1) and cooperating with a device (4) for feeding said machine (5), said feed device (4) being of the type arranged to control and regulate the tension of the yarn (2) to make it equal to a predefined value, there being provided a control unit (6) connected to each feed device (4) for controlling the feed of all yarns to the textile machine, the absorbed yarn length value to be maintained for each yarn (2) fed to the textile machine (5) being set to a predefined setpoint value, characterised in that said unit (6) is connected to synchronism means arranged to define a particular moment in which said control unit compares data relative to the actual yarn quantity fed by at least one device (4) with the predefined setpoint value memorized by said unit, said comparison enabling said unit to determine any discrepancy between said actual quantity and the predefined setpoint value and to intervene on at least one of these devices (4), to modify the feed tension of the corresponding yarn such that all the yarns (2) are fed to the machine (5) in the same length or quantity.

16. An arrangement as claimed in claim 15, characterised in that said unit (6) is external to all the feed devices (4), said unit being connected to these latter, to receive data from them relative to the yarn quantity fed by them and to control their tensioning action on said yarns.

17. An arrangement as claimed in claim 16, characterised in that the external unit (6) is connected to the feed devices by a serial connection.

18. An arrangement as claimed in claim 15, characterised in that the control unit (6) forms part of one of the feed devices (4) but controls the operation of all said devices (4).

19. An arrangement as claimed in claim 15, characterised in that the control unit (6) forms part of each feed device (4).

20. An arrangement as claimed in claim 15, characterised in that the synchronism means are functionally connected to the textile machine (5).

21. An arrangement as claimed in claim 10, characterised in that the synchronism means form part of the textile machine (5).

22. An arrangement as claimed in claim 21, characterised in that the synchronism means are means for sensing the position of a rotating member of the textile machine (5).

* * * * *